US006536482B1

(12) United States Patent
Peeters et al.

(10) Patent No.: US 6,536,482 B1
(45) Date of Patent: Mar. 25, 2003

(54) AUXILIARY NOZZLE FOR A WEAVING MACHINE

(75) Inventors: Jozef Peeters, Ieper (BE); Joseph Verhulst, Zillebeke (BE); Jean Marie Bamelis, Ieper (BE)

(73) Assignee: Picanol N.V., Ieper (BE)

( * ) Notice: Subject to any disclaimer, the term of this patent is extended or adjusted under 35 U.S.C. 154(b) by 0 days.

(21) Appl. No.: 09/926,313

(22) PCT Filed: Apr. 14, 2000

(86) PCT No.: PCT/EP00/03369

§ 371 (c)(1),
(2), (4) Date: Oct. 12, 2001

(87) PCT Pub. No.: WO00/63473

PCT Pub. Date: Oct. 26, 2000

(30) Foreign Application Priority Data

Apr. 14, 1999 (BE) ..... 9900257

(51) Int. Cl.[7] ..... D03D 47/30

(52) U.S. Cl. ..... 139/435.5; 226/97.4; 239/589.1

(58) Field of Search ..... 139/435.5, 188 R, 139/192; 226/97.4; 239/589.1

(56) References Cited

U.S. PATENT DOCUMENTS

| | | | | | |
|---|---|---|---|---|---|
| 4,585,038 | A | * | 4/1986 | Knisely | 139/435.5 |
| 4,655,262 | A | * | 4/1987 | Scheffel et al. | 139/435.6 |
| 4,915,141 | A | * | 4/1990 | Nitta et al. | 139/435.5 |
| 6,138,719 | A | * | 10/2000 | Kerner et al. | 139/435.5 |

* cited by examiner

*Primary Examiner*—John J. Calvert
*Assistant Examiner*—Robert H. Muromoto, Jr.
(74) *Attorney, Agent, or Firm*—Bacon & Thomas, PLLC

(57) ABSTRACT

The invention relates to an airjet weaving-machine auxiliary nozzle (8) in the form of a hollow needle (11) having a closed tip (12), the auxiliary nozzle having a bulge at its distal end extending towards one side only of the nozzle centerline, such that the bulge extends towards a reed of a weaving machine in which the nozzle is installed relative to the centerline.

40 Claims, 6 Drawing Sheets

FIG. 7
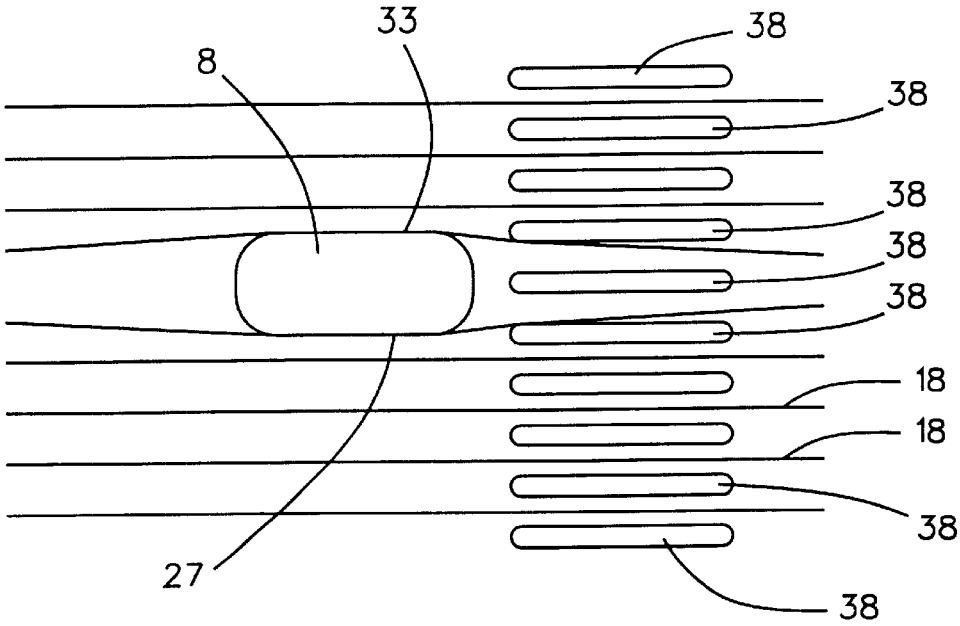
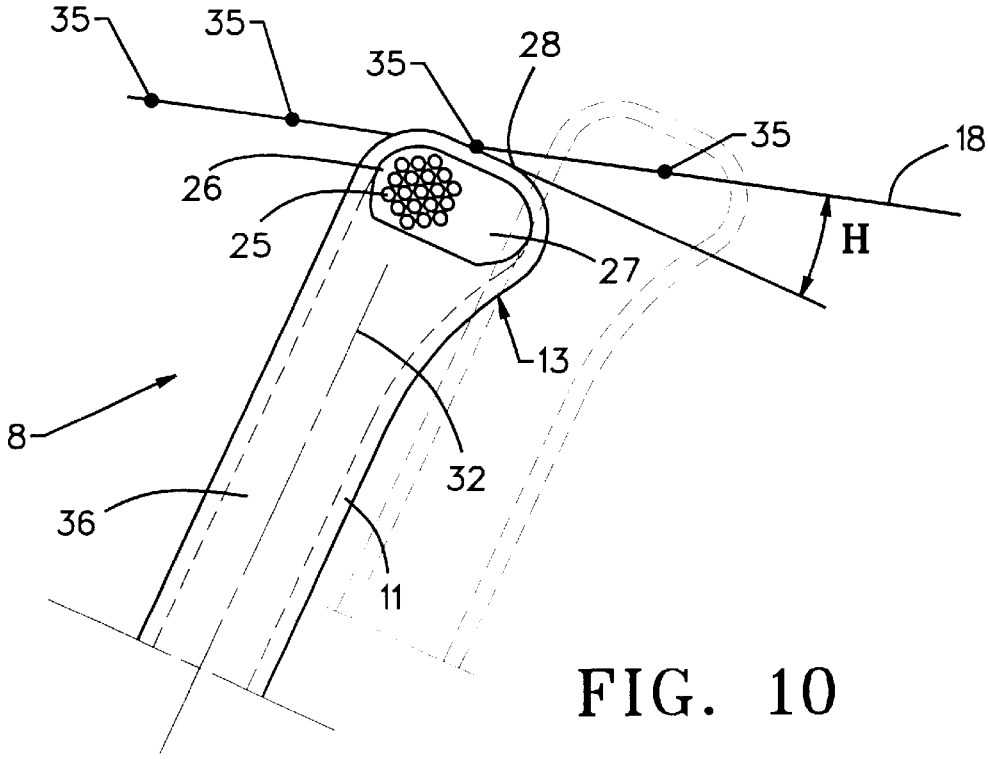
FIG. 10

AUXILIARY NOZZLE FOR A WEAVING MACHINE

FIELD OF THE INVENTION

The present invention relates to a weaving-machine auxiliary nozzle which is configured as a hollow needle which, in a wall adjoining a closed tip, includes one or several outflow apertures that, when the auxiliary nozzle is mounted on the weaving machine, is directed towards a filling-yarn insertion duct.

BACKGROUND OF THE INVENTION a. Description of Related Art

Such auxiliary nozzles are known from U.S. Pat. No. 5,020,574. They enhance filling insertion into a weaving machine's shed. Several such auxiliary nozzles are distributed for that purpose across the width of the batten and they each supply a flow of fluid supporting the motion of a filling yarn blown into a filling yarn insertion duct associated with the batten. The auxiliary nozzles are arrayed in such a way that blow aperture(s) disposed in a wall underneath the tip shall point in a given direction toward the upper wall and the back wall of the filling insertion duct. The fluid streams from the blow apertures flow substantially in the longitudinal direction of the filling insertion duct and include an upward and oblique component.

During weaving the auxiliary nozzles move through the lower plane of warps into the shed at each filling insertion. It was observed that warps consisting of several thin and individual filaments and exhibiting only a slight twist will fray/unravel at those sites where the auxiliary nozzles pass through the plane of the warps in one direction into and then back out of the shed. Such fraying/unraveling arises foremost in filament yarns wherein thin synthetic filaments substantially run parallel to one another and are welded to each other at regular spacings. In such cases the fabric has an appearance at the sites where the auxiliary nozzles move through the lower warp plane that differs from the appearance of the remaining fabric. These warps are bulkier in the region of the auxiliary nozzles than the remaining warps because these thin filaments no longer are rigorously configured next to each other.

b. Summary of the Invention

It is the objective of the present invention to design an auxiliary nozzle of the above described kind so that the danger of damaging the warps is reduced.

This goal is attained in that in its tip area the hollow needle includes a bulge pointing towards the reed when the auxiliary nozzle is mounted on the weaving machine.

The auxiliary nozzle of the invention not only reduces the danger of finding its way between the individual filaments of a warp, but also precludes the fluid flow(s) through the outflow aperture(s) from adversely affecting the warps.

To facilitate moving the auxiliary nozzle through the lower plane of warps into and out of the shed, the invention appropriately assures that the bulge's walls shall continuously adjoin the hollow needle's walls. As a further advantage, the bulge includes a wall which is substantially flush with the wall that contains the outflow aperture(s).

In a further embodiment of the invention, the hollow needle's inner volume expands into the bulge zone. In this case the cross-section of the inner volume may be decreased in the related perpendicular direction. As a result a further advantageous design allows increasing the thickness of at least the wall comprising the outflow apertures. This wall thickness may be increased without thereby decreasing the flow cross-section towards the outflow apertures and increasing the flow impedance, because the expansion of the inner volume increasing the flow cross-section in the bulge zone.

Thereupon, in a further embodiment of the invention, the outflow aperture(s) are designed as nozzles. Such nozzle allows improved collimation and directionality of the fluid jet(s), and as a result such jets will be more effective in driving a filling.

Moreover the bulge makes it also possible to place the cross-sectional surface of the outflow aperture(s) required for the given quantity of fluid closer to the tip of the hollow needle. This feature offers the advantage that the outflow aperture(s) when entering a shed will move earlier past the warps and when leaving the shed will move past them later, and consequently the time interval within which a fluid flow is supplied by the auxiliary nozzles can be enlarged without thereby affecting the warps.

In a further embodiment of the invention, the hollow needle's tip comprises a substantially straight top edge extending as far as the bulge zone. Advantageously the top edge subtends an angle of 70 to 110° with the hollow needle's longitudinal axis.

BRIEF DESCRIPTION OF THE DRAWINGS

Further advantages and features of the invention are illustrated in the following embodiment shown in the drawings and in the sub-claims.

FIG. 7 is a section along line VII—VII of FIG. 3, FIG. 10 is an enlarged elevation of the auxiliary nozzle of FIGS. 8 and 9.

DETAILED DESCRIPTION

Figure 1:
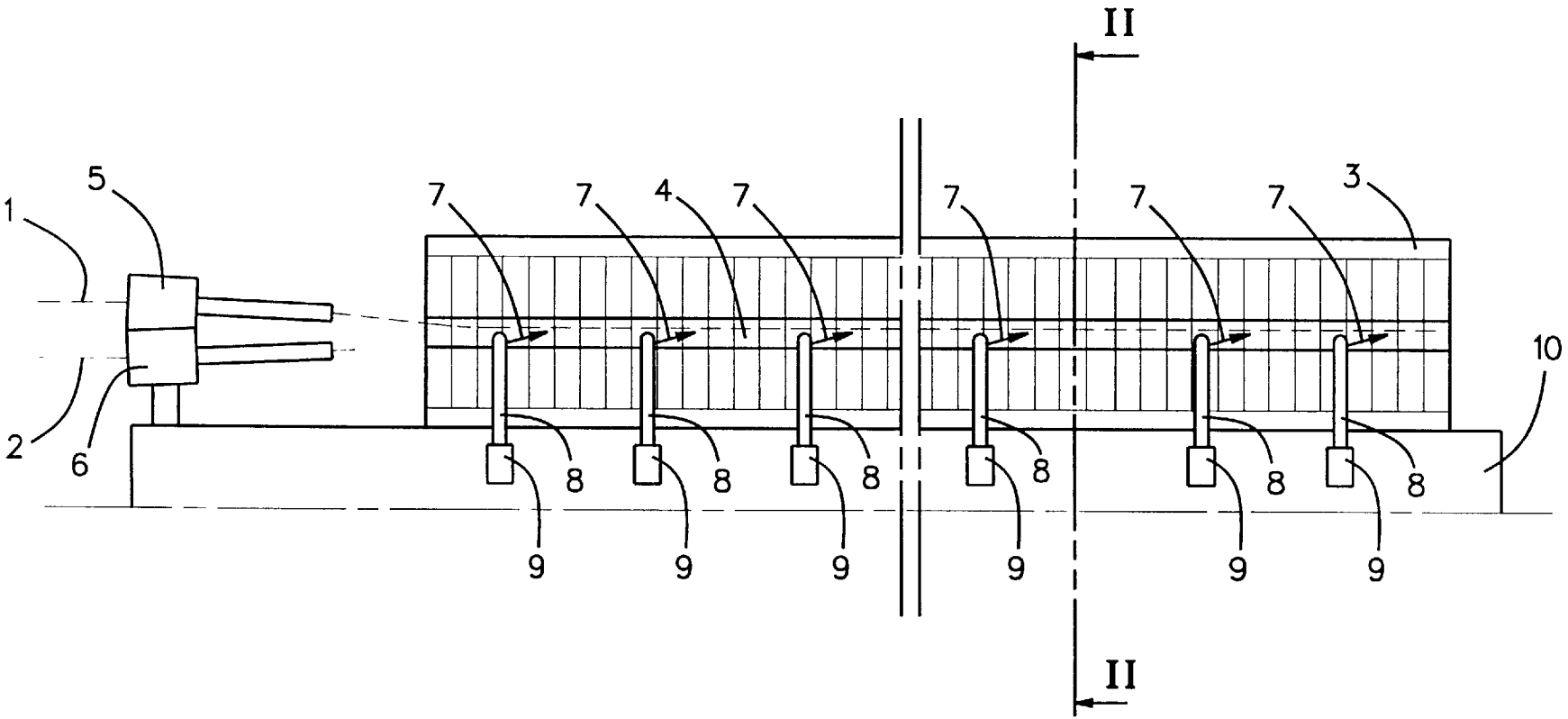
FIG. 1 schematically shows part of an airjet loom with several auxiliary nozzles.
Figure 2:
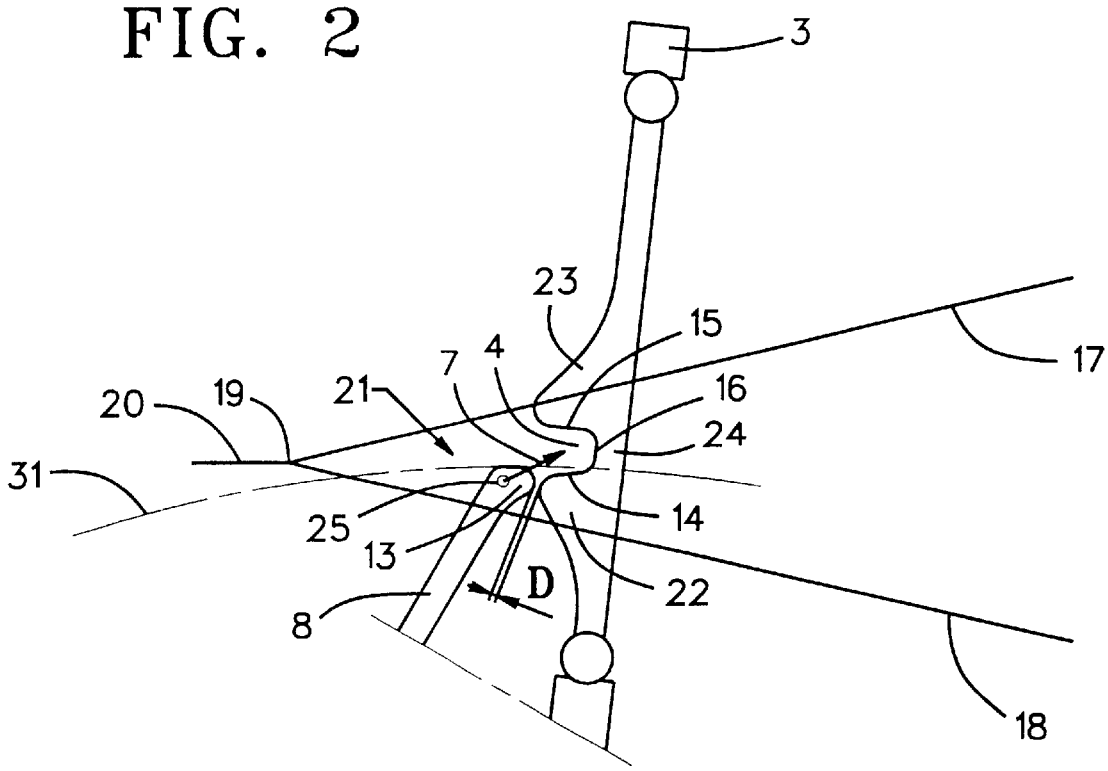
FIG. 2 is a section along line II—II, with the reed and the auxiliary nozzles in their rearmost positions.
Figure 3:
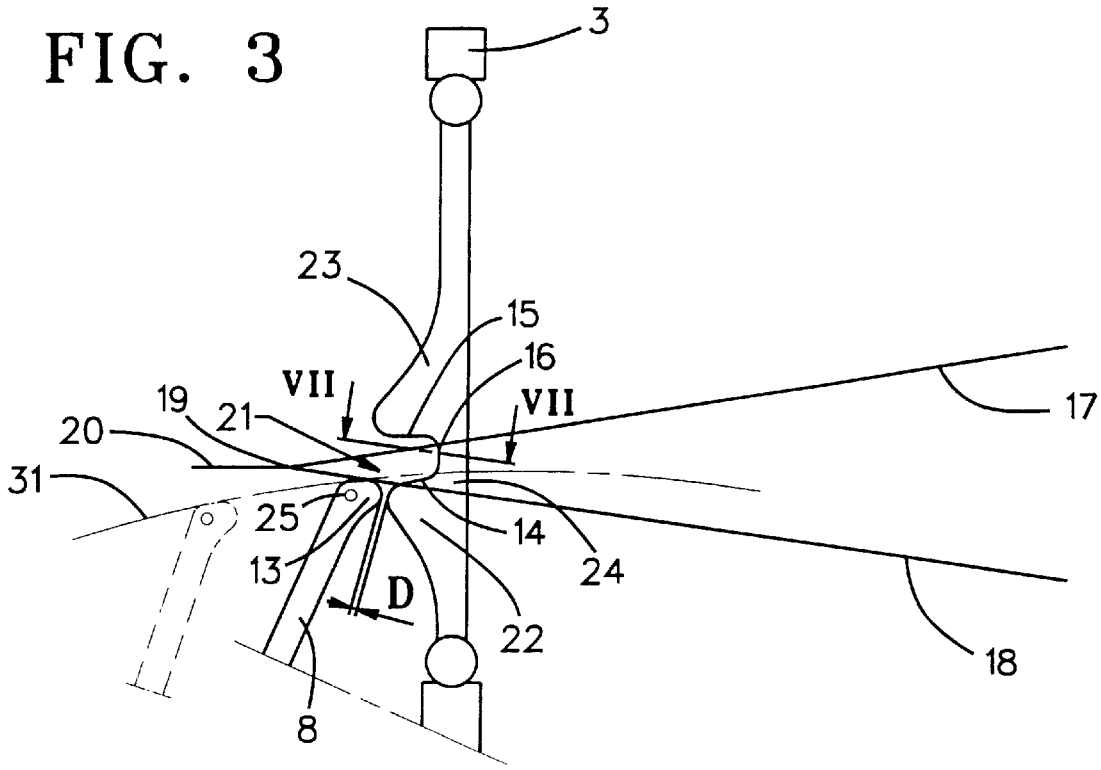
FIG. 3 is a section similar to that of FIG. 2 during the batten motion when the auxiliary nozzle(s) move(s) through a lower warp plane.

The weaving machine shown in FIG. 1 comprises a reed 3 consisting of a plurality of dents each fitted with a recess so as to constitute a U-shaped filling insertion duct 4. Fillings 1, 2 are inserted into this filling insertion duct 4 in a shed 21 defined by warps configured in an upper and a lower plane of warps 17, 18 resp. as shown in FIGS. 2 and 3. The fillings 1 and 2 resp. are blown-in by main blowing nozzles 5 and 6. Further transportation of the fillings 1 or 2 in the filling insertion duct 4 is supported by airjets 7 produced by auxiliary nozzles 8. The airjets 7 are directed substantially in the longitudinal direction of the filling insertion duct 4 transversely of the nozzles but have a direction component which is oblique and slightly upward and which points toward the upper wall 15 and the back wall of the filling insertion duct 4 and onto the fillings 1, 2. The reed 3, the main blow nozzles 5, 6 and the supports 9 of the auxiliary nozzles 8 are mounted on a cross-sectionally shaped batten bar 10 of a batten in the manner illustratively known from U.S. Pat. No. 5,020,574. This batten bar 10 illustratively is affixed by batten supports to a batten shaft (not shown) driven in reciprocating motion.

As shown in FIGS. 2 and 3, a shed 21 consists of an upper plane of warps 17 and a lower plane of warps 18 which converge into the beatup line 19 where the fillings are beaten by the reed 3 into a fabric 20. A filling is beaten by the back wall 16 of the U-shaped filling insertion duct 4, said back wall belonging to the central part 24 of said reed. The upper segment 23 of the dents of the reed 3 constitutes an upper wall 15 of the guide duct 4. The lower wall 14 of the guide duct 4 is constituted of the lower portion 22 of the dents of the reed 3.

Figure 4:
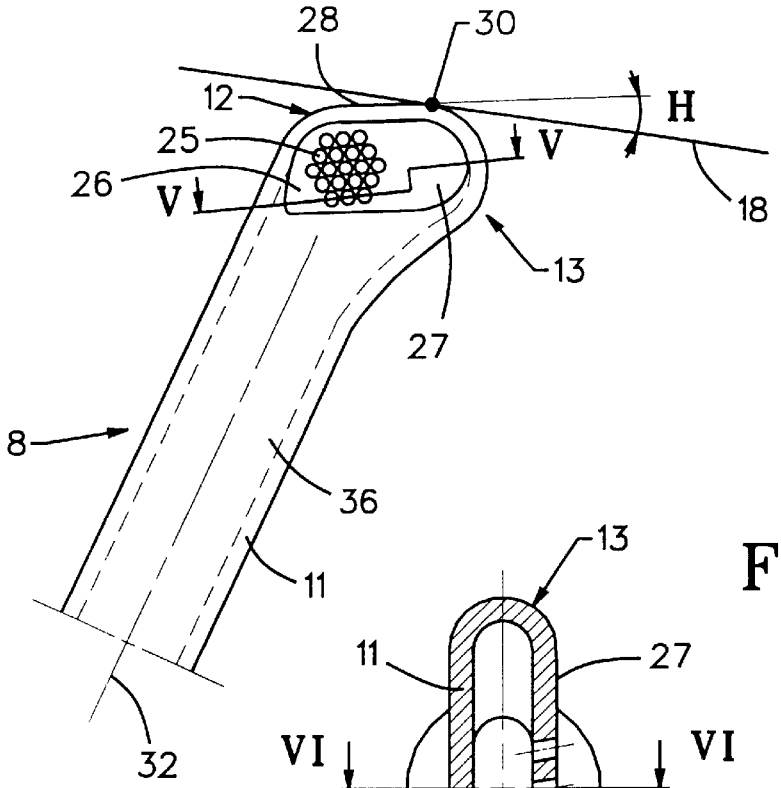
FIG. 4 is an enlarged sideview of an auxiliary nozzle of the invention.

As shown in FIGS. 2 through 6, the auxiliary nozzle 8 is configured like a hollow needle 11 which is fitted near its tip 12 with an outflow aperture 25 in a sidewall 26. As shown by FIG. 4, the outflow aperture 25 comprises a plurality of smaller apertures. The hollow needle 11 of the auxiliary nozzle 8 includes, in the vicinity of the tip 12, a single lateral bulge 13 which faces the reed 3 when the auxiliary nozzle 8 is mounted on the batten. The bulge 13 extends generally perpendicular to the direction of the outflow nozzles and comprises a sidewall 27 constituting an extension of the sidewall 26 of the hollow needle 11 fitted with the outflow aperture 25. The bulge 13 is located near the lower portion 22 of the reed 3 in the region of the lower wall 14 of the filling insertion duct 4. The distance D between the bulge 13 and the lower portion 22 of the reed illustratively is less than 3 mm.

The auxiliary nozzle 8 comprises a top edge 28 extending up to the region of the bulge 13. This top edge 28 is substantially straight and by means of roundings of comparatively large radii adjoins the hollow needle 11 and the bulge 13. The highest point 30 of the tip 12 of the hollow needle 11 is situated in the region of the bulge 13. As shown by FIGS. 2 and 3, the top edge 28 of the auxiliary nozzle 8 when mounted on said reed extends approximately tangentially to a circle 31 centered on the axis of the batten shaft. In the embodiment of FIGS. 2 through 6, the top edge 28 extends at an angle of about 110° relative to the longitudinal axis 32 of the auxiliary nozzle 8. The top edge 28 may extend at angles of 70 to 110° preferably relative to the axis 32.

By means of the batten motion and at each filling insertion, the auxiliary nozzles 8 are moved between the warps of the warp plane 18 into the shed 21 and following filling beatup are then moved again through the warp plane 18 out of the shed 21. The auxiliary nozzles 8 move from the dashed-line position shown in FIG. 3 into the position shown in FIG. 2 and then back. Said nozzles assume intermediate positions during this motion as indicated for instance in FIG. 3. When the tips 12 of the auxiliary nozzles 8 are moving through the lower warp plane 18, the top edges 28 of the auxiliary nozzles 8 will subtend an angle H with said plane 18. This angle H is defined in such a way that the highest point 30 on the top edge 28 of the bulge 13 situated near the reed 3 shall first make contact with said lower warp plane 18. It must be borne in mind in this respect that the warp planes 17 and 18 have moved apart so they attain the position shown in FIG. 2 when the auxiliary nozzles 8 penetrate the lower warp plane 18.

As shown in FIG. 7, the warps guided through the dents 38 of the reed 3 are deflected by the auxiliary nozzle 8 as this nozzle moves through the warps of the lower warp plane 18. These warps then are stretched. In the process, the warps 18 rest against the sidewalls 27, 33 of the bulge 13 and against the dents 38 of the reed 3. As a result, the warps 18 near the blow aperture 25 of the auxiliary nozzles 8 shall be tensioned. As a result of tensioning the warps formed of several adjacent, thin filaments, these filaments therefore shall be slightly compressed against one another. Consequently the airjet 7 from the auxiliary nozzles 8 is less able to penetrate between the individual filaments. Hence warp fraying/unraveling will be reduced.

Figure 5:
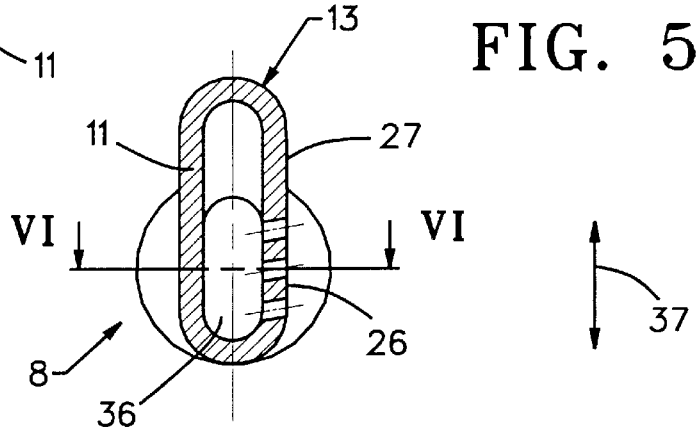
FIG. 5 is a section along line V—V of FIG. 4.

As shown by FIGS. 4 and 5, the cross-section of the inner volume 36 of the hollow needle 11 of the auxiliary nozzle 8 expands at the level of the bulge 13 (direction of arrow 37 in FIG. 5) on account of this bulge 13.

In the embodiment mode shown in FIGS. 8 through 11, the auxiliary nozzle 8 also is fitted with lateral bulge 13 pointing toward the reed 3. The top edge 28 extends over the hollow needle's tip and across the bulge 13 and subtends an angle of about 90° with the longitudinal axis 32 of the needle 11. When entering the shed through the lower warp plane 18, the top edge 28 will subtend an angle H with this lower plane 18, this angle H being such that the portion of the top edge 28 facing the reed 3 is the last to make contact with the warps of the lower warp plane 18 and the portion of the top edge 28 away from the reed 3 is the first one. While the auxiliary nozzle 8 is moving through the warp plane 18, then, as shown in FIG. 10, the top edge 28 will guide the weld nodes 35 which connect substantially mutually parallel yarn filaments of a warp thread of the lower warp plane 18 to each other. A weld node 35 is able to slide over the top edge 28 of the auxiliary nozzle 8 moving into the shed and to assume the position indicated in FIG. 10 in dashed lines. Because of the substantial length of the top edge 28 and on account of the angle H, the auxiliary nozzle 8 is precluded from inserting itself between the individual filaments of a warp thread at the lower warp plane 18. The top edge 28 is of such a length that the auxiliary nozzle 8, which moves jointly with the batten, cannot penetrate a warp thread of the lower warp plane 18 between two consecutive weld nodes 35. As a result the motion of the auxiliary nozzles 8 cannot rip open the weld nodes 35.

The angle subtended between the top edge 28 and the longitudinal axis 32 and/or the geometry of the auxiliary nozzles 8 formed as hollow needles 11 shall be matched to the material of the warps being processed in such a way that warps shall not be damaged when the shed is being entered, for instance such that they shall neither fray nor unravel. Preferably this angle shall be of a magnitude between 70 and 110°.

The cross-section of the interior volume 36 of the hollow needle 11 of the auxiliary nozzle 8 is less where the bulge 13 begins (direction of arrow 34 in FIG. 11) than in the previous segment 39. In the region of the outflow aperture 25, the wall thickness of the auxiliary nozzle 8 is larger than in the remaining region of the tip 12. The larger wall thickness makes it possible to better guide the fluid jet in the individual apertures of the outflow aperture, because the length of said apertures being greater. In this manner too, there is less danger that an airjet 7 (FIG. 1) shall damage the warps.

The interior volume 36 within the auxiliary nozzle 8 can easily be configured for advantageous flow, that is, to support an airjet 7 out of the outflow aperture 25. Illustratively the inner bead 29 shown in FIG. 11 may be used for that purpose, which improves deflecting the fluid flow toward the outflow aperture 25.

Figure 12:
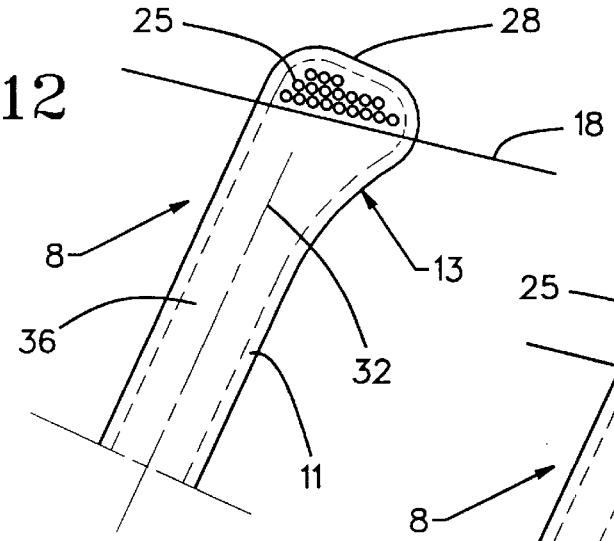
FIG. 12 is a view of a modified embodiment of an auxiliary nozzle.

In the embodiment mode of FIG. 12, the individual apertures of the outflow aperture 25 are situated closer to the top edge 28 of the auxiliary nozzle 8 and are not distributed on a circular surface, but are configured in three superposed rows. In this design the individual apertures also extend in the zone of the bulge 13 and as a result the same number of individual apertures (in this illustrative embodiment there are nineteen individual apertures) may be confined more closely to the top edge 28, that is, the same total cross-section may be attained for the outflow aperture 25. Because this outflow aperture 25 in this embodiment fully crosses the lower warp plane 18 earlier, the fluid outflow may begin earlier. Because in the corresponding opposite motion the outflow aperture 25 moves later through the lower warp plane 18 out of the shed, the fluid flow out of the auxiliary nozzle 8 may be extended.

Figure 13:
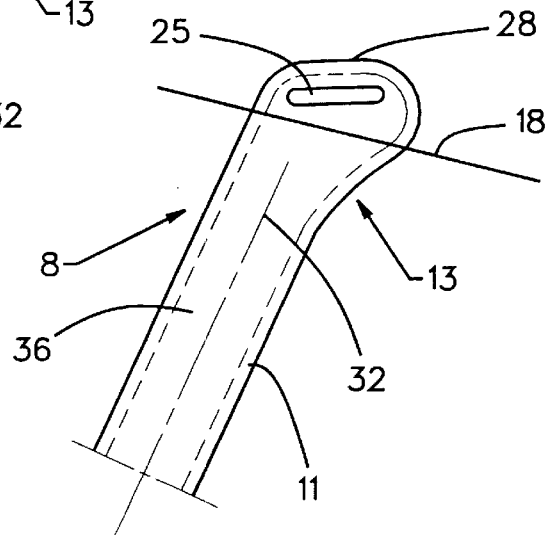
FIG. 13 is a further embodiment of an auxiliary nozzle.
Figure 14:
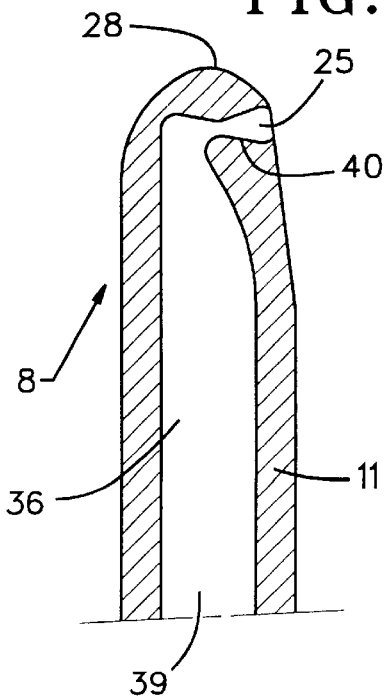
FIG. 14 is a longitudinal section of the auxiliary nozzle of FIG. 13.

As regards the embodiment of FIGS. 13 and 14, the outflow aperture 25 has the shape of a slotted nozzle extending substantially parallel to the top edge 28 of the auxiliary nozzle 8. As shown in FIG. 14, this outflow aperture 25 is relatively long and furthermore has the geometry of a nozzle 40, in particular that of a Laval nozzle. In this manner a strip-like supersonic airjet 7 may be attained at the outlet of the nozzle aperture 25. Such a strip-like, collimated airjet only slightly loads the nearby warps of the lower warp plane 18 and the danger of these warps fraying/unraveling shall be reduced. Moreover the collimated airjet 7 may forcefully drive a filling 1 or 2. Also the auxiliary nozzle 8 of FIGS. 13 and 14 offers the advantages of the embodiment of FIG. 12.

Figure 15:
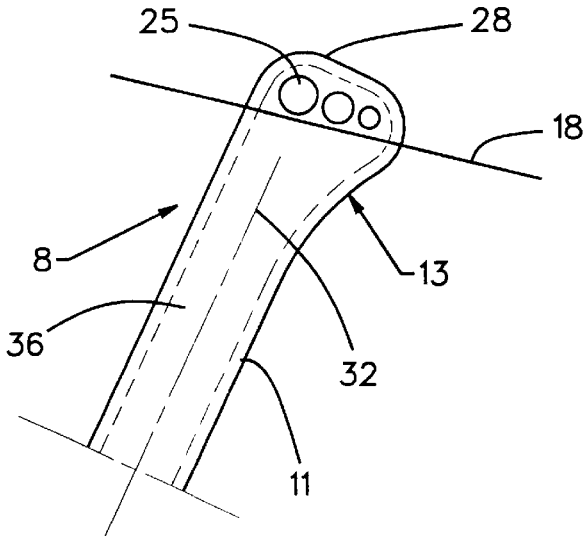
FIG. 15 shows yet another embodiment of an auxiliary nozzle.

The embodiment of FIG. 15 is similar to that of FIG. 12. However the outflow aperture 25 includes only of a small number of individual apertures, in this example only three apertures of different flow cross-sections. The apertures' flow cross-sections are smallest in the region of the bulge 13 and largest at the locations farthest from said bulge.

The auxiliary nozzle 8 of the invention is not limited to blowing an airjet 7, but instead it may also be used with another fluid moving a filling. Such a fluid illustratively may be a liquid such as water, as a result of which a liquid jet would be directed on the wefts. Again a gas may be used as the fluid, or a gas containing a liquid spray or fog, for instance a gas holding atomized water.

Figure 11:
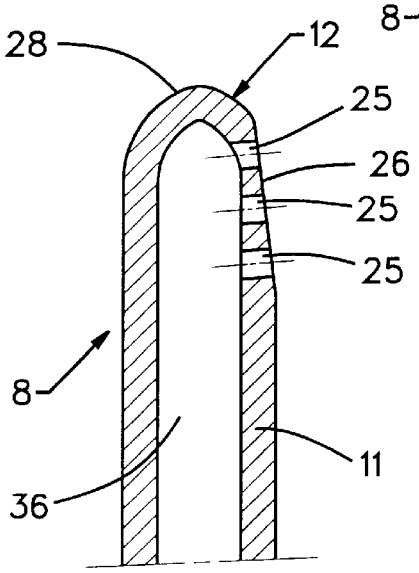
FIG. 11 is an enlarged section similar to that of FIG. 6 of the auxiliary nozzle of FIGS. 8 and 9.
Figure 6:
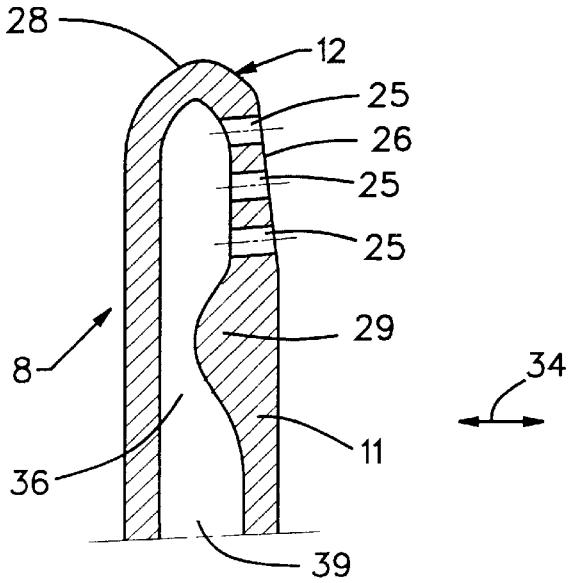
FIG. 6 is a section along line VI—VI of FIG. 5.
Figure 8:
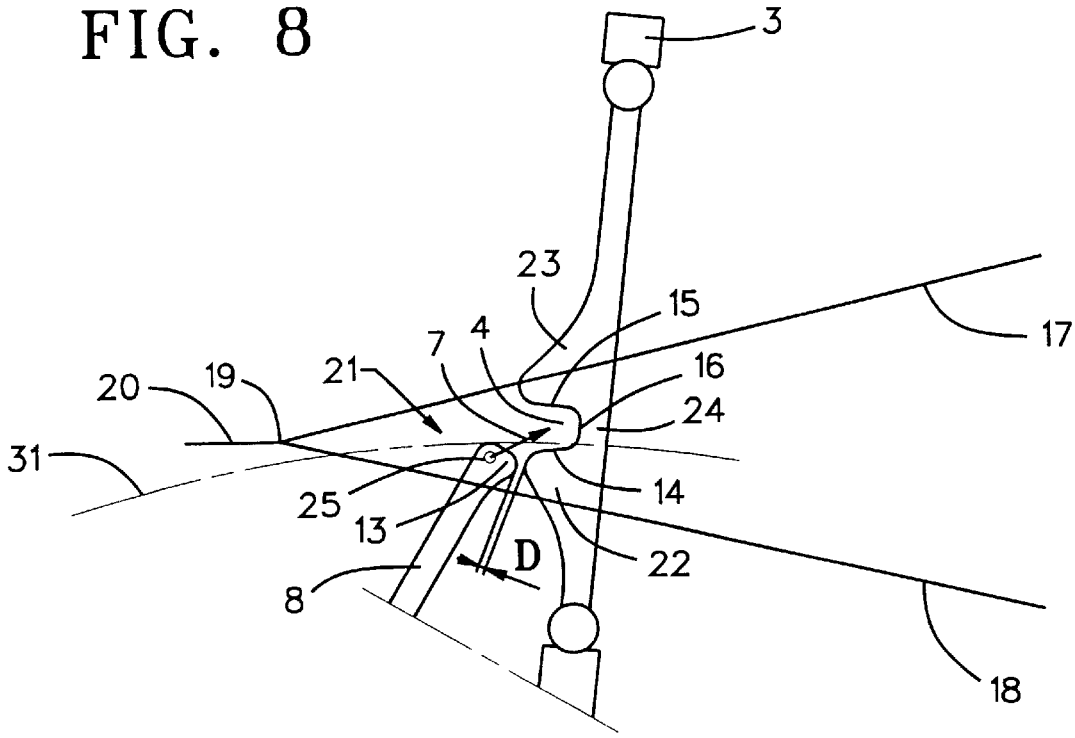
FIG. 8 is a section similar to that of FIG. 2 of a modified embodiment.
Figure 9:
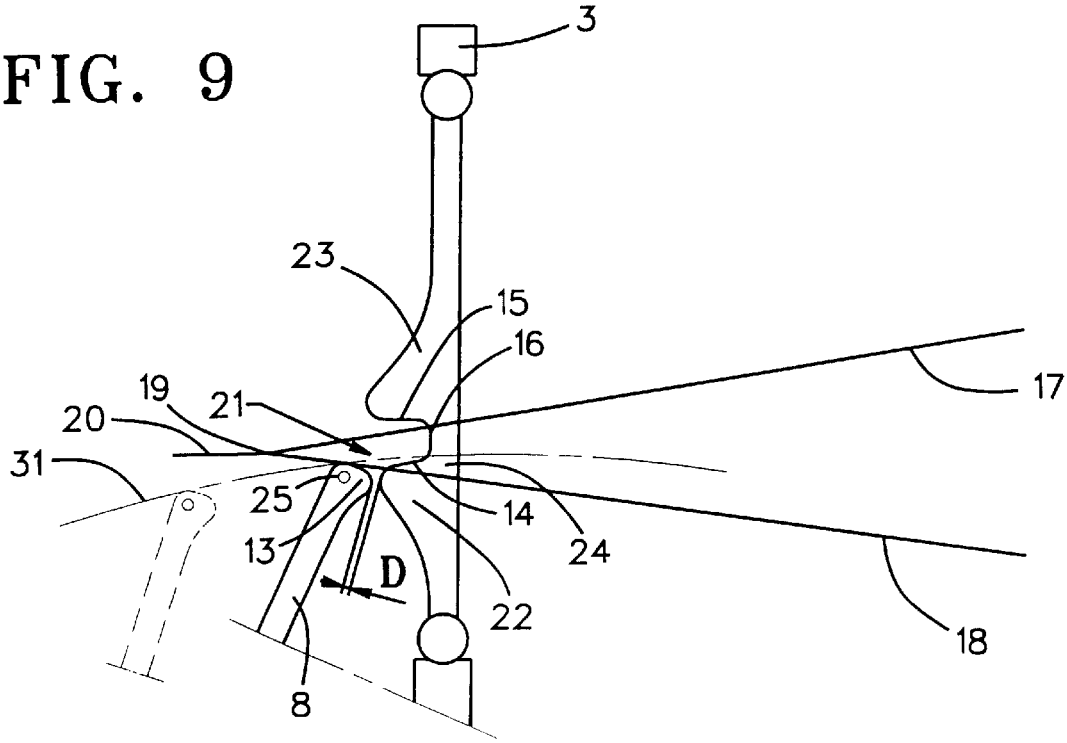
FIG. 9 is a section corresponding to that of FIG. 3 of the embodiment mode of FIG. 8.

The invention is not limited to the above described embodiments. Instead combinations of those embodiments are feasible, for instance the auxiliary nozzle 8 of FIG. 6 may comprise an inner space of the auxiliary nozzle 8 as shown in FIG. 11. The scope of protection is solely determined by the patent claims.

What is claimed is:

1. An auxiliary nozzle (8) for a weaving machine configured as a hollow needle (11) and comprising one or more outflow apertures (25) in a wall (26) adjoining a closed tip (12), said apertures (25) being directed towards a filling insertion duct (4) when said auxiliary nozzle is mounted on a weaving machine, characterized in that the hollow needle (11) extends along a longitudinal axis and comprises a bulge (13) which is located in the region of its tip (12) and extends towards one side only of the longitudinal axis, and the nozzle is configured so that it may be installed in a weaving machine with the bulge extending toward a reed (3) of the machine.

2. The auxiliary nozzle as claimed in claim 1, characterized in that the walls of the bulge (13) continuously merge with the walls of the hollow needle (11).

3. The auxiliary nozzle as claimed in claim 1, characterized in that the bulge (13) comprises a wall (27) which is substantially flush with the wall (26) containing the outflow aperture(s) (25).

4. The auxiliary nozzle as claimed in claim 1, characterized in that the inner volume of the hollow needle (11) widens at the region of the bulge (13) and preferably is constricted perpendicularly thereto.

5. The auxiliary nozzle as claimed in claim 1, characterized in that at least the wall (26) fitted with the outflow aperture(s) (25) has a larger wall thickness.

6. The auxiliary nozzle as claimed in claim 5, characterized in that each outflow aperture comprises a nozzle.

7. The auxiliary nozzle as defined in claim 1, characterized in that the tip (12) of the hollow needle (11) comprises a substantially straight top edge (28) extending into the region of the bulge (13).

8. The auxiliary nozzle as claimed in claim 7, characterized in that the top edge (28) subtends an angle of 70 to 110° with the longitudinal axis (32) of the hollow needle (11).

9. The auxiliary nozzle as claimed claim 7, characterized in that the highest portion (30) of the top edge (28) is situated in the region of the bulge (13).

10. The auxiliary nozzle as claimed in claim 7, characterized in that the top edge (28) of the tip (12) extends in a longitudinal warp direction when the auxiliary nozzle (8) is mounted on a weaving machine.

11. The auxiliary nozzle as claimed in claim 7, wherein the auxiliary nozzle (8) is configured so that it may be mounted on a weaving machine having a batten pivoting about a batten axis, with the top edge (28) of the tip (12) substantially extending tangentially to a circle (31) centered on the batten axis.

12. The auxiliary nozzle as claimed in claim 7, wherein the auxiliary nozzle (8) is configured to be mountable on a weaving machine with a top edge (28) of the tip (12) mounted substantially near the lower portion (22) of a U-shaped filling insertion duct (4) of a reed (3) of the machine.

13. The auxiliary nozzle as claimed in claim 7, wherein the auxiliary nozzle (8) is configured to be mountable on a weaving machine with the bulge (13) located at a distance (D) of less than 3 mm from a lower portion (22) of a U-shaped filling insertion duct (4) of a reed (3) of the machine.

14. The auxiliary nozzle as claimed in claim 7, wherein the auxiliary nozzle (8) is configured to be mountable on a weaving machine with the top edge (28) of the tip (12) penetrating a shed (21) constituted by warps and subtending an acute angle (H) with a lower warp plane (18) of the shed.

15. The auxiliary nozzle as claimed in claim 7, wherein the auxiliary nozzle (8) is configured to be mountable on a weaving machine with the zone of the top edge (28) extending away from the reed (3) and such that said top edge comes into contact with a lower warp plane (18).

16. The auxiliary nozzle as claimed in claim 15, wherein the length of the top edge (28) of the tip (12) is larger than a distance between weld nodes (35) of a warp (1, 2) constituted by a plurality of individual filaments with which the nozzle is adapted to cooperate.

17. In an airjet weaving machine including a filling insertion duct including a U-shaped insertion duct having a lower portion, a reed, a batten pivotable about a batten axis, a shed area wherein longitudinally extending warp threads define a lower warp plane and at least one auxiliary nozzle in the form of a hollow needle and having a longitudinal centerline and being arranged to be moved about the batten axis in its generally longitudinal direction so it's tip moves into and out of the shed through the warp threads of the lower warp plane, said hollow needle comprising one or more outflow apertures in a wall adjoining a closed tip, the improvement comprising:

said nozzle having a bulge at it's tip extending in a single direction only relative to it's centerline, said direction extending toward the reed.

18. The improvement as claimed in claim 17, wherein the walls of the bulge continuously merge with the walls of the hollow needle.

19. The improvement as claimed in claim 17, wherein the bulge comprises a wall which is substantially flush with the wall containing the outflow apertures.

20. The improvement as claimed in claim 17, wherein the hollow needle comprises an inner volume, said inner volume widens at the region of the bulge and is constricted in a direction perpendicular to the longitudinal axis in a direction extending transversely of the direction of the bulge relative to the longitudinal axis.

21. The improvement as claimed in claim 17, said nozzle including a wall containing said outflow apertures and wherein said wall has a greater wall thickness in the area of the outflow apertures relative to the thickness of the needle wall at a location remote from the apertures.

22. The improvement as claimed in claim 21, wherein each outflow aperture is configured as a nozzle.

23. The improvement as claimed in claim 17, wherein the tip of the needle comprises a substantially straight top edge extending into the region of the bulge.

24. The improvement as claimed in claim 23, wherein the top edge subtends an angle of 70–110° relative to the direction of the longitudinal axis of the needle.

25. The improvement as claimed in claim 23, wherein the highest portion of the top edge is located in the region of the bulge.

26. The improvement as claimed in claim 23, wherein the top edge of the tip extends parallel to the thread direction.

27. The improvement as claimed in claim 23, wherein the top edge of the tip of the nozzle extends tangentially relative to a circle centered on the batten axis.

28. The improvement as claimed in claim 23, wherein the top edge of the tip is mounted substantially near the lower portion of the filling insertion duct.

29. The improvement as claimed in claim 23, wherein the bulge is located at a distance of less than 3 mm from the lower portion of the filling insertion duct.

30. The improvement as claimed in claim 17, wherein the top edge subtends an acute angle relative to the lower warp plane when the nozzle is located adjacent the lower warp plane.

31. The improvement as claimed in claim 23, wherein the top edge located away from the reed engages the lower warp plane threads before the portion of the top edge located toward the reed.

32. The improvement as claimed in claim 31, wherein said warp threads are constituted by a plurality of individual filaments and include weld nodes, and wherein the length of said top edge is greater than the distance between weld nodes of individual warp threads.

33. An auxiliary nozzle for a weaving machine comprising a hollow, elongated needle having one or more outflow apertures in a wall adjoining an otherwise closed tip, said apertures being directed laterally in a first direction relative to a central longitudinal axis of the nozzle, and a single bulge located at the tip, said bulge extending laterally in a single second direction extending transversely of the longitudinal axis and generally perpendicular to the first direction.

34. An auxiliary nozzle as claimed in claim 33, wherein the bulge comprises a wall which is substantially flush with the wall containing the outflow apertures.

35. An auxiliary nozzle as claimed in claim 33, wherein the inner volume of the hollow needle widens at the region of the bulge and is constricted in a direction perpendicular to the direction of the bulge.

36. An auxiliary nozzle as claimed in claim 33, wherein the wall containing the outflow apertures has a greater wall thickness than the thickness of the wall of the hollow needle at a location remote from the apertures.

37. An auxiliary nozzle as claimed in claim 33, wherein each outflow aperture comprises a nozzle.

38. An auxiliary nozzle as claimed in claim 33, wherein the tip comprises a substantially straight top edge extending into the region of the bulge.

39. An auxiliary nozzle as claimed in claim 38, wherein said top edge subtends an angle of 70–110° relative to the longitudinal axis of the needle.

40. The auxiliary nozzle as claimed in claim 38, wherein the highest portion of the top edge us located in the region of the bulge.

* * * * *